US011408305B2

(12) United States Patent
Garnier et al.

(10) Patent No.: US 11,408,305 B2
(45) Date of Patent: Aug. 9, 2022

(54) LUBRIFICATION DEVICE FOR A TURBO MACHINE

(71) Applicant: SAFRAN AIRCRAFT ENGINES, Paris (FR)

(72) Inventors: Fabien Stéphane Garnier, Moissy-Cramayel (FR); François Pierre Michel Comte, Moissy-Cramayel (FR); Arnaud Lasantha Genilier, Moissy-Cramayel (FR); Vincent François Georges Millier, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 627 days.

(21) Appl. No.: 16/395,823

(22) Filed: Apr. 26, 2019

(65) Prior Publication Data

US 2019/0331001 A1 Oct. 31, 2019

(30) Foreign Application Priority Data

Apr. 26, 2018 (FR) ..... 1853693

(51) Int. Cl.
*F01D 25/18* (2006.01)
*F01D 5/02* (2006.01)

(52) U.S. Cl.
CPC ..... *F01D 25/18* (2013.01); *F01D 5/02* (2013.01); *F05D 2220/32* (2013.01); *F05D 2230/60* (2013.01); *F05D 2260/98* (2013.01)

(58) Field of Classification Search
CPC . F01D 25/16; F01D 25/18; F01D 5/02; F05D 2220/32; F05D 2230/60; F05D 2260/98
See application file for complete search history.

(56) References Cited

U.S. PATENT DOCUMENTS 3,285,004 A * 11/1966 Hopley ..... F01D 25/18 60/39.08
4,389,984 A * 6/1983 Destrampe ..... F01D 25/18 123/196 S (Continued)

FOREIGN PATENT DOCUMENTS

EP 2407640 A2 1/2012
FR 2 977 636 A1 1/2013

(Continued)

OTHER PUBLICATIONS

French Application No. 1853693; Search Report dated Jan. 28, 2019—10 pgs. (relevance found in the citations therein).

*Primary Examiner* — Courtney D Heinle
*Assistant Examiner* — Andrew Thanh Bui
(74) *Attorney, Agent, or Firm* — Lathrop GPM LLP

(57) ABSTRACT

The invention relates to a lubrication device (1) for a turbo machine, comprising:
- a rotor (2) rotating around an axis,
- at least one lubrication chamber (6) formed in the rotor (2),
- a stator (22) in which the rotor (2) is rotatably mounted,
- a bearing (11) for rotationally guiding the rotor (2), mounted between the rotor (2) and the stator,
- lubricating fluid supply means which supply at least the chamber (6) and the bearing (11), the lubricating fluid supply means comprising a nozzle (23) mounted on the stator provided with an ejection nozzle (34) at a free end of the nozzle (23), said nozzle (34) being configured to project the lubricating fluid into the chamber (6),
- characterized in that the nozzle (23) has a movable part (27) including said ejection nozzle (34), said movable part (27) being movable between a retracted position in which the ejection nozzle (34) is remote from the (Continued)

chamber (6) or at least partially located outside the chamber (6), and an extended position in which the nozzle (34) is closer to the chamber (6) or at least partially located in the chamber (6).

12 Claims, 4 Drawing Sheets

(56) References Cited

U.S. PATENT DOCUMENTS

| | | | | |
|---|---|---|---|---|
| 9,951,651 | B2 * | 4/2018 | Frantz | F16C 33/6659 |
| 2006/0108807 | A1 | 5/2006 | Bouiller et al. | |

FOREIGN PATENT DOCUMENTS

| | | | |
|---|---|---|---|
| FR | 3026135 | A1 | 3/2016 |
| FR | 3 036 441 | A1 | 11/2016 |
| FR | 3 036 729 | A1 | 12/2016 |

* cited by examiner

LUBRIFICATION DEVICE FOR A TURBO MACHINE

CROSS-REFERENCE TO RELATED APPLICATION

This application claims priority to French Patent Application No. 1853693, filed Apr. 26, 2018, which is incorporated herein by reference.

DOMAIN OF THE INVENTION

The present invention relates to a lubrication device for a turbo machine, particularly for an aircraft turbojet engine or a turboprop engine.

BACKGROUND

A turbo machine typically includes, from upstream to downstream in the direction of gas flow within the turbo machine, a fan, one or more compression stages, a combustion chamber, one or more turbine stages and a gas exhaust nozzle. The compression stages and turbine stages have rotors that can be connected to each other by one or more rotating shafts. The shafts are guided in rotation by bearings. In order to allow lubrication and cooling of these bearings, the turbo machine typically has a lubrication system.

Document FR 3 036 441 discloses an assembly for a turbo machine comprising a shaft rotating about the axis of the turbo machine, a bearing supporting the rotating shaft, at least one lubrication chamber and means for supplying lubrication fluid extending between the lubrication chamber and said bearing. The shaft, bearing and chamber are housed in a fixed part of the turbo machine.

A nozzle is mounted on the fixed part, the nozzle having an oil ejection nozzle at its radially inner free end, said nozzle being arranged to project the lubricant into the lubrication chamber. The lubricant is then distributed to the bearing through channels. Such oil distribution is facilitated by the centrifugal forces exerted during operation.

During operation of the turbo machine, it appears that some of the lubricant ejected through the nozzle does not flow into the lubrication chamber and therefore does not contribute effectively to the lubrication of the bearing.

SUMMARY OF THE INVENTION

The invention aims to remedy this disadvantage in a reliable, simple and inexpensive way.

To this end, the invention concerns a lubrication device for a turbo machine, said device comprising:

- a rotor with a shaft rotating around an axis,
- at least one lubrication chamber formed in the rotor, means for supplying lubrication fluid extending between the chamber and said bearing,
- a fixed part in which the rotor is mounted,
- a rotating rotor guide bearing, mounted between the rotor and the fixed part,
- a nozzle mounted on said fixed part and having an oil ejection nozzle at one end, said nozzle being arranged to project the lubricant into the lubrication chamber, characterized in that the nozzle has a fixed part and a movable part, said movable part comprising said nozzle, said movable part being movable between a retracted position in which the nozzle is remote from the enclosure or is located at least partially outside the enclosure, and a deployed position in which the nozzle is moved closer to the enclosure or located at least partially within the enclosure.

During the assembly of the turbo machine, the fixed element and the nozzle are moved axially with respect to the rotor, or vice versa. During such an assembly, the movable part of the nozzle is held in a retracted position so as to avoid any contact between the radially inner free end of the movable part of the nozzle and the rotor, for example. After axial displacement of the fixed element and nozzle relative to the rotor, the movable part of the nozzle can be moved to its extended position so as to approach or insert the nozzle into the lubrication chamber.

The lubricating fluid can be oil.

The nozzle may include return means, such as elastic return means, mounted between the fixed and movable part of the nozzle, the return means being designed to move the movable part of the nozzle to its retracted position.

The return means are for example formed by a spring, such as a helical compression spring. Of course, any other type of device allowing a recall function can also be used.

The movable part of the nozzle comprises a piston engaged in a cylinder of the fixed part of the nozzle, the lubricating fluid flowing through the nozzle being intended to exert a force on the piston, the movable part of the nozzle being able to be moved to its deployed position by applying said force on the piston, against the return means.

The nozzle is for example radially oriented. The moving part is then located radially inside the fixed part, at least in part. The piston can be formed at the radially outer free end of the movable part. The nozzle can be formed at the radially inner end of the movable part. The force exerted by the lubricant on the piston depends on the pressure of the lubricant in the cylinder, and the surface of the piston exposed to the lubricant.

The fixed part of the nozzle may have a lubricant supply channel leading into the cylinder.

The movable part of the piston may comprise at least one primary channel and at least two opposite secondary channels, connected to the primary channel, the lubricating fluid passing through the said movable part being able to successively pass through the primary channel and the secondary channels before opening into the lubricating chamber.

The primary channel can lead into the cylinder at the piston. The secondary channels can be diametrically opposite. The secondary channels can be at an angle with the primary channel. The primary channel is for example radially oriented.

The section of each secondary channel can be smaller than the section of the primary channel.

The nozzle can extend radially inward from said fixed part, the rotor having a substantially cylindrical area.

In the extended position, the ejection nozzle of the nozzle can be located in the lubrication chamber, at least partially. In this way, it is ensured that all the lubricating fluid enters the lubrication chamber.

The rotor may have lubrication channels connecting the lubrication chamber to the bearing.

The rotor may have at least one deflecting wall extending axially, for example upstream in relation to the direction of gas flow in the turbo machine, and radially outwards, the lubrication chamber being delimited at least in part by the deflecting wall.

The deflecting wall ensures that all the lubricant is directed to the lubrication chamber.

The lubrication assembly may include means for rotating the moving part of the nozzle in relation to the fixed part.

Such coupling means ensure the correct orientation of the ejection nozzle of the nozzle.

The invention also concerns a process for assembling a turbo machine lubrication device as defined above, this process comprising:

- moving the movable part of the nozzle to the retracted position,
- mounting the rotor axially inside the fixed part, so that the movable part of the nozzle is axially arranged opposite the lubrication chamber,
- optionally, moving the movable part of the nozzle to the extended position.

The movable part of the nozzle can be moved into the extended position by circulation of a lubricant through the nozzle, in particular under the effect of the force exerted by the lubricant on the piston.

BRIEF DESCRIPTION OF THE FIGURES

The invention will be better understood and other details, characteristics and advantages of the invention will become readily apparent upon reading the following description, given by way of a non limiting example with reference to the appended drawings, wherein.

DETAILED DESCRIPTION

Figure 1:
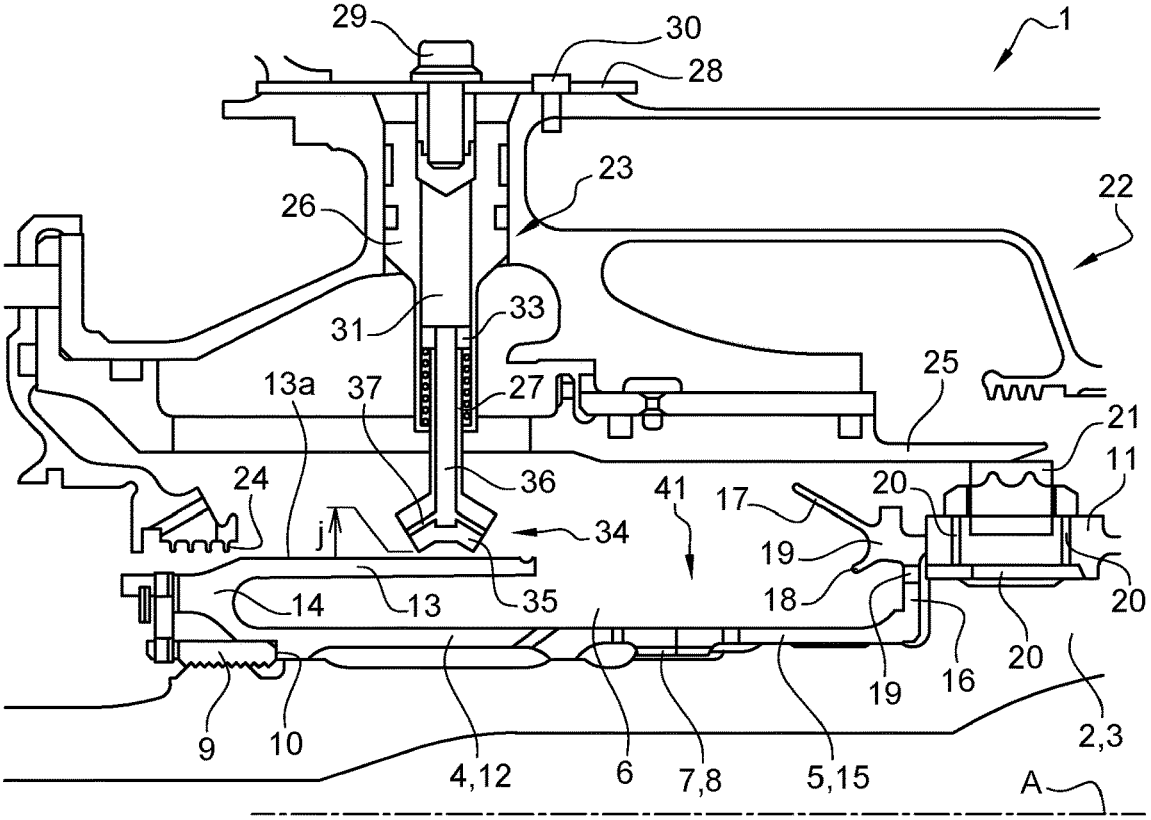
FIGS. 1 to 3 are cross-sectional half-views of a lubrication device for a turbo machine according to one embodiment of the invention, in several successive mounting and/or operating positions.
Figure 2:
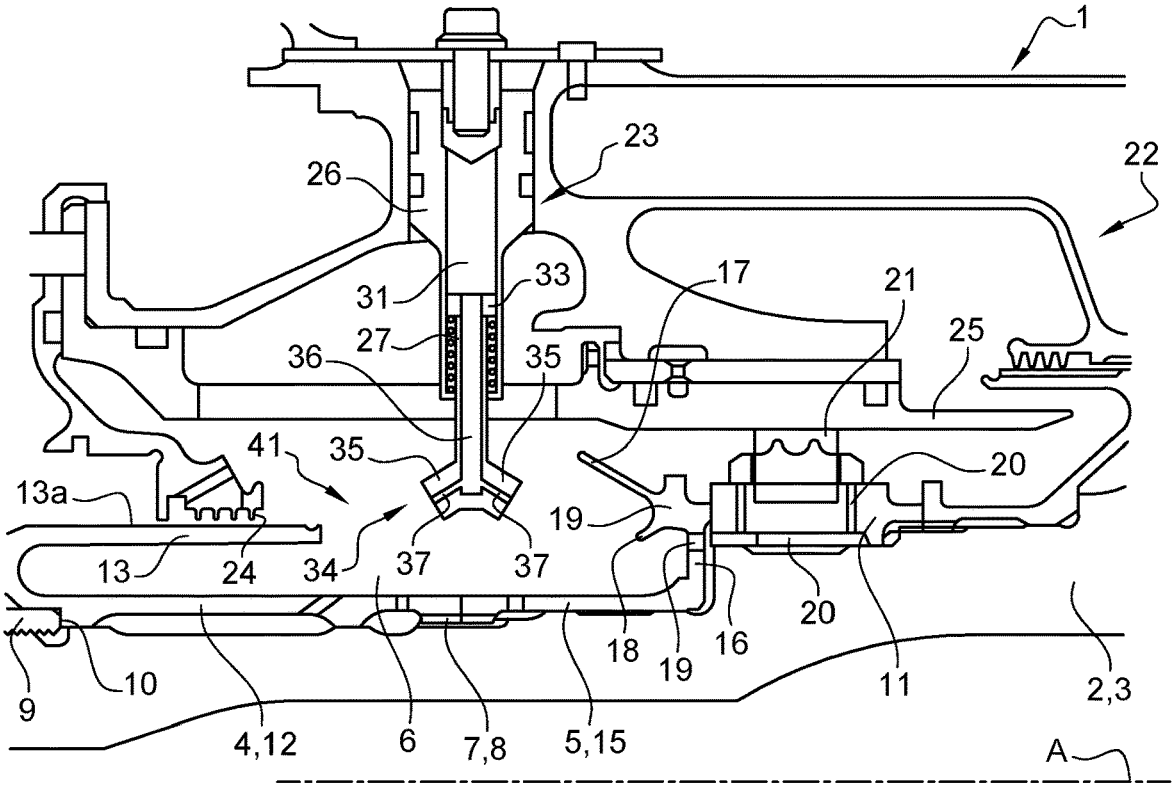
Figure 3:
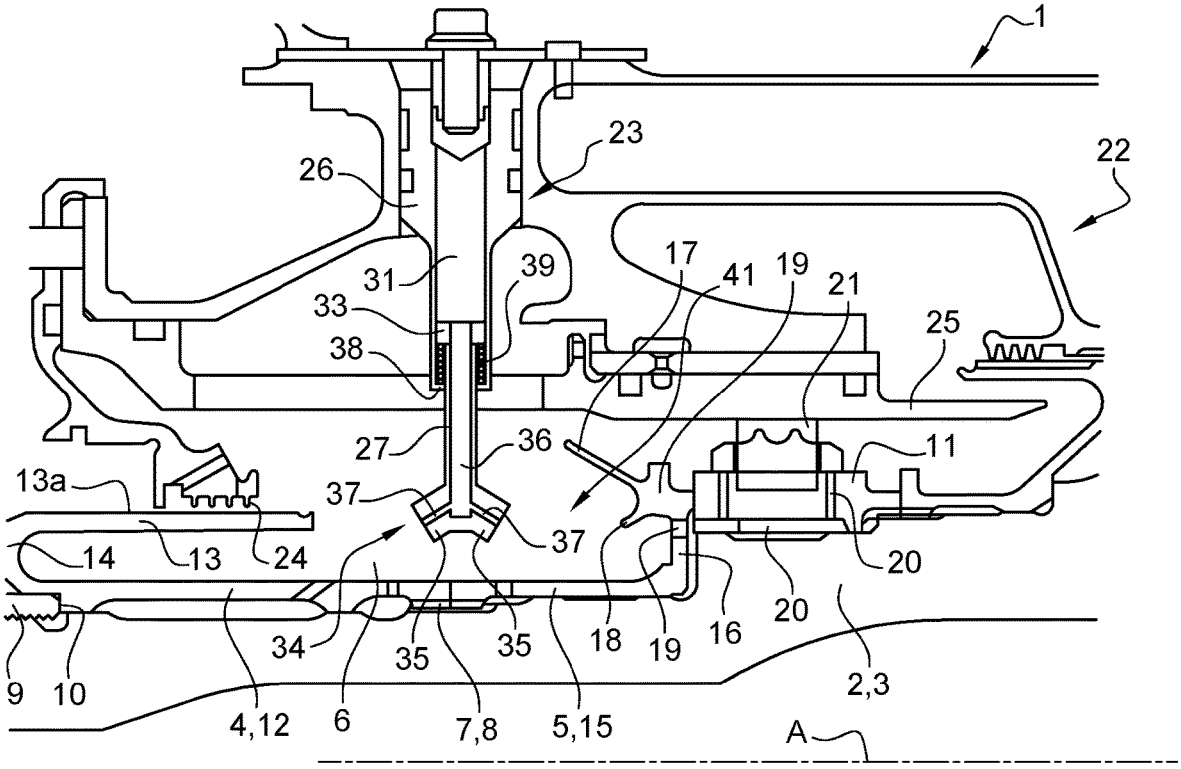

FIGS. 1 to 3 show a lubrication device 1 for a turbo machine according to one embodiment of the invention. The lubrication device 1 comprises a rotor 2 extending along the A axis of the turbo machine, rotor 2 comprising a radially inner rotating shaft 3, a first ring 4 and a second ring 5 mounted around the shaft 3. The first ring 4 and the second ring 5 delimit a lubrication chamber 6.

Each ring 4, 5 has a toothed or notched part 7, cooperating with a toothed or notched part 8 of the shaft 3 so as to rotationally immobilize the first ring 4 and the second ring 5 with respect to the shaft 3. The first ring 4 is secured axially with respect to shaft 3 by means of a nut 9 located upstream of the first ring 4 and supported on a shoulder 10 of the first ring 4. The nut 9 is screwed onto a threaded part of the shaft 3. A bracket 11 is mounted around the shaft 3 downstream of the second ring 5, the second ring 5 bearing axially on said bracket 11. Bracket 11 is axially fixed with respect to shaft 3.

The first ring 4 has a radially inner cylindrical part 12 and a radially outer cylindrical part 13, radially spaced from each other, which face each other and are connected by a connecting part 14. The connecting part 14 is located upstream of said cylindrical parts 12, 13.

The second ring 5 has a radially inner cylindrical part 15 whose downstream end is extended by a radially outwardly extending part 16 equipped with a deflector. The deflector has a radially outer deflecting wall 17 and a radially inner deflecting wall 18, connected in this case by a curved area 19. The radially inner deflecting wall 18 has a smaller dimension than the radially outer deflecting wall 17. The radially outer deflecting wall 17 extends upstream and radially outwards. The radially inner deflecting wall 18 extends upstream and radially inward.

The radial part 16 of the second ring 5 and the bracket 11 have ports 19 and lubrication channels 20 which lead to a bearing 21 mounted on bracket 11.

The lubrication device 1 also includes a fixed part or stator 22 in which a nozzle 23 is mounted. The fixed part 22 has sealing means comprising knife edge sealings 24 capable of cooperating with the outer surface of the radially outer part 13 of the first ring 4 of rotor 2. The fixed part 22 also has an axially extending nozzle guide part 25, the bearing 21 being mounted between the bracket 11 of rotor 2 and nozzle guide part 25.

Nozzle 23 has a fixed part 26 and a movable part 27 extending radially. The fixed part 26 of the nozzle 23 is mounted on the fixed part 22 of the lubrication device 1, for example by means of a plate 28 and screws 29, 30. The fixed part 26 of nozzle 23 has a cylinder 31, i.e. a bore 31, and a lubricant supply channel 32 (FIG. 4) leading into cylinder 31.

The movable part 27 has a radially outer free end enlarged to form a piston 33, a radially inner free end forming an ejection nozzle 34 and having two diametrically opposed branches 35, each branch 35 extending along an axis B, B' (FIG. 7) forming a non-zero angle with respect to the radial direction and with respect to the axial direction A.

The movable part 27 has one or more main channels 36 extending axially extended by secondary channels 37 extending along the axis B, B'.

Figure 5:
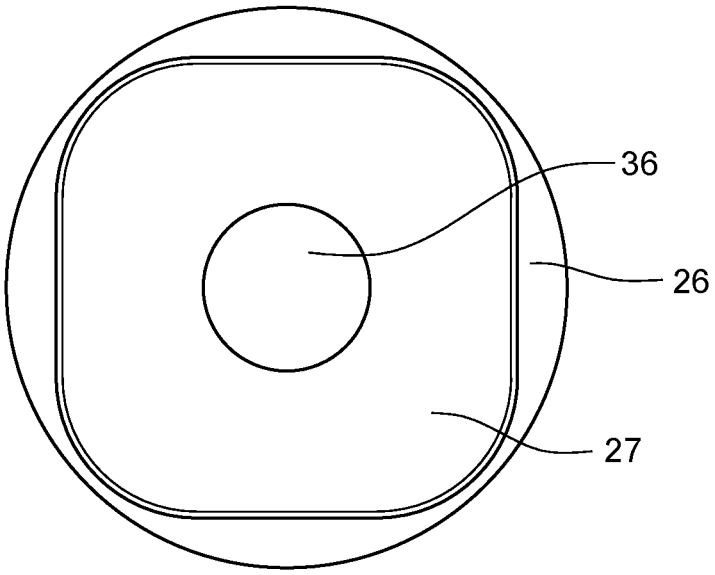
FIGS. 5 and 6 show rotational coupling means located between the fixed and movable parts of the nozzle, according to two embodiments.
Figure 6:
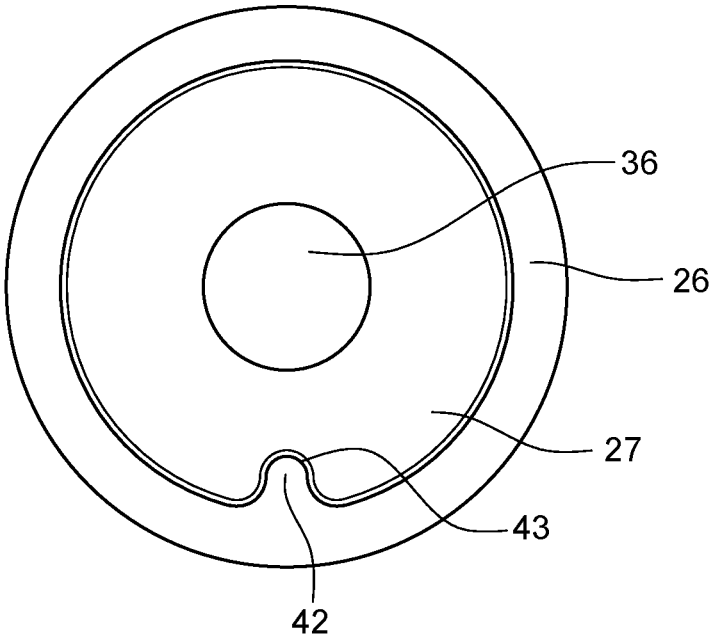

FIGS. 1 to 3 illustrate the case where the moving part 27 has a single primary channel 36. FIGS. 5 and 6 illustrate the case where the moving part 27 has two main channels 36.

Each secondary channel 37 is formed in a branch 35 which extends axially and projects radially from the moving part 27. The section of each secondary channel 37 is smaller than the section of the primary channel 36.

Branches 35 and secondary channels 37 form the lubricating fluid ejection nozzle 34.

The radially inner free end of the fixed part 26 of the nozzle 23 forms an annular shoulder 38. Elastic return means 39 are mounted between piston 33 of the movable part 27 and said shoulder 38 of the fixed part 26. In this case, the elastic return means 39 are formed by a helical compression spring.

Figure 7:
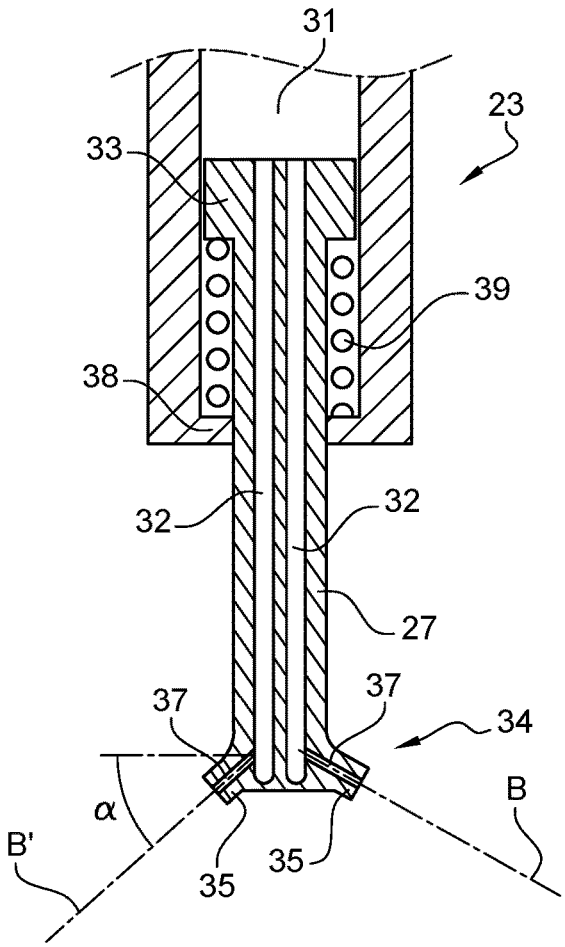
FIGS. 7 and 8 are cross-sectional views of the nozzle, with the movable part in the retracted and extended positions, respectively.
Figure 8:
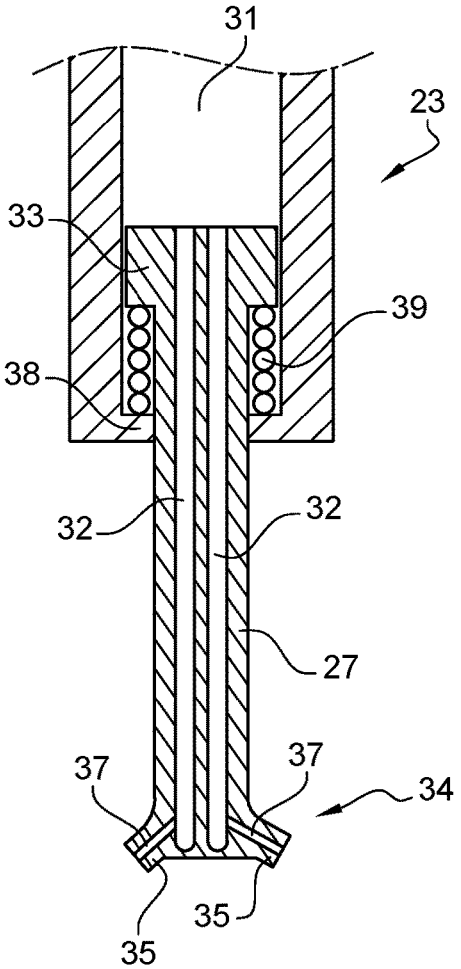

The movable part 27 can be moved radially with respect to the fixed part 26, between a retracted position visible in particular in FIG. 7, and an extended position visible in FIG. 8.

Figure 4:
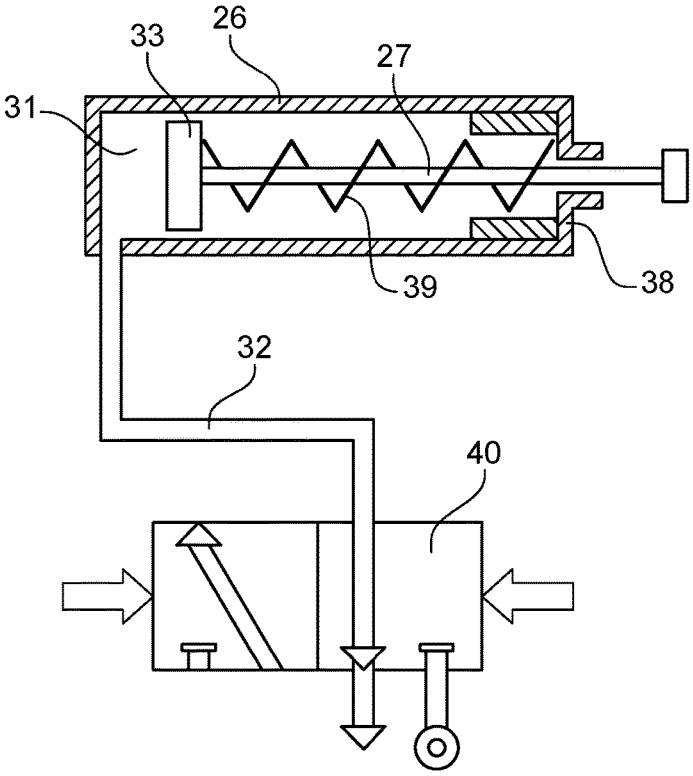
FIG. 4 is a schematic view showing the operation of the nozzle, in particular the movable part, by means of a hydraulic distributor or a controlled valve.

The lubrication device also includes fluid supply means for the nozzle 23, shown in particular in FIG. 4. These supply means include a hydraulic distributor 40 or a controlled valve connected by a supply line 32 to nozzle 23, in particular to the fixed part 26 of nozzle 23.

Rotational coupling means may be provided to prevent the rotation of the movable part 27 of the nozzle 23 with respect to the fixed part 26, about the axis of the nozzle 23, which corresponds to the translational displacement axis of the movable part 27 with respect to the fixed part 26.

For this purpose, as shown in FIG. 5, the movable part 27 may have a non-cylindrical section, for example polygonal, more particularly of a general square shape, mounted in a housing with a shape which is complementary to the fixed part 26.

Alternatively, as shown in FIG. 6, the fixed part 26 may have a coupling stud or rib 42, engaged in a complementary recess or groove 43 in the movable part 27, or vice versa.

Of course, any other shape allowing a rotational coupling between the movable part 27 and the fixed part 26 can be used.

The mounting of such a lubrication device will now be described while referring to FIGS. 1 to 4.

As shown in FIG. 1, the movable part 27 of nozzle 23 is first moved to its retracted position by the elastic return means 39. Rotor 2 can then be engaged axially from downstream to upstream in fixed part 22, or vice versa. The retracted position of the movable part 27 is defined in such a way that, during such axial displacement, there is a radial clearance j between the radially inner free end of the ejection nozzle 34 of the nozzle 23 and the outer surface 13*a* of the radially outer cylindrical part 13 of the first ring 4 of rotor 2.

The axial displacement of rotor 2 with respect to the fixed part 22 is continued until the nozzle 35 is axially located between the downstream end of the radially outer cylindrical part 13 of the first ring 4 and the deflecting walls 17, 18 of the second ring 5, as shown in FIG. 2. The nozzle 34 is then located axially opposite an opening 41 of the lubrication chamber 6.

In use, when the nozzle 23 is supplied with lubricating fluid, said fluid enters the cylinder 31 of the nozzle 23 and exerts a force on the piston 33 of the movable part 27 of the nozzle 23 in such a way that said movable part 27 is moved radially inward, i.e. towards its extended position, against the return force exerted by the elastic return means, as shown in FIG. 3. The nozzle 34 then enters the lubrication chamber 6, at least in part.

Such a position of the nozzle 34 makes it possible to efficiently and almost completely, or even completely, bring the lubricating fluid into the lubrication chamber 6. This lubrication fluid can then supply bearing 21 through port 19 of the second ring 5 and through channels 20 of bracket 11.

As soon as the nozzle 23 is no longer supplied with lubrication fluid, the movable part 27 is returned to its retracted position by the elastic return means 39.

It should be noted that disassembly of rotor 2 in relation to the fixed part 26 can easily be carried out in steps opposite to those of the assembly process described above, for example for maintenance.

The invention claimed is:

1. A lubrication device (1) for a turbo machine comprising:

a rotor (2) rotating around an axis, at least one lubrication chamber (6) formed in the rotor (2), a stator (22) in which the rotor (2) is rotatably mounted, a bearing (11) for rotationally guiding the rotor (2), mounted between the rotor (2) and the stator, lubricating fluid supply means which supply at least the chamber (6) and the bearing (11), the lubricating fluid supply means comprising a nozzle (23) mounted on the stator provided with an ejection nozzle (34) at a free end of the nozzle (23), said ejection nozzle (34) being configured to project the lubricating fluid into the chamber (6), characterized in that the nozzle (23) has a fixed part (26) and a movable part (27), said movable part (27) having said ejection nozzle (34), said movable part (27) being movable between a retracted position in which the ejection nozzle (34) is remote from the chamber (6) or located at least partially outside the chamber (6), and an extended position in which the ejection nozzle (34) is closer to the chamber (6) or located at least partially within the chamber (6).

2. The lubrication device (1) according to claim 1, characterized in that the nozzle (23) has return means (39), mounted between the fixed part (26) and the movable part (27) of the nozzle (23), the return means (39) being configured to move the movable part (27) of the nozzle (23) to its retracted position.

3. The lubrication device (1) according to claim 2, characterized in that the movable part (27) of the nozzle (23) has a piston (33) which slides in a cylinder (31) of the fixed part (26) of the nozzle (23), the lubricating fluid flowing through the nozzle (23) being intended to exert a force on the piston (33), the movable part (27) of the nozzle (23) being capable of being moved to its extended position by applying said force on the piston (33), against the return means (39).

4. The lubrication device (1) according to claim 1, characterized in that the movable part (27) comprises at least one primary channel (36) and at least two opposite secondary channels (37) connected to the primary channel (36), the lubrication fluid passing through said movable part (27) being able to successively pass through the primary channel (36) and the secondary channels (37) before opening in the lubrication chamber (6).

5. The lubrication device (1) according to claim 1, characterized in that the nozzle (23) extends radially inwardly from said fixed part (22), the radial distance between the rotor and the ejection nozzle (34) of the nozzle (23) in its retracted position being configured to allow the rotor to be mounted in the stator by axial insertion.

6. The lubrication device (1) according to claim 1, characterized in that, in the extended position, the ejection nozzle (34) of the nozzle (23) is located at least partially in the lubrication chamber (6).

7. The lubrication device (1) according to claim 1, characterized in that the rotor (2) has lubrication channels (19, 20) connecting the lubrication chamber (6) to the bearing (11).

8. The lubrication device (1) according to claim 1, characterized in that the rotor (2) has at least one deflecting wall (17, 18) extending radially outwards and/or axially, the chamber (6) being delimited at least in part by the deflecting wall (17, 18).

9. The lubrication device according to claim 1, wherein the movable part (27) of the nozzle (23) is configured to be moved into the extended position by circulation of a lubricating fluid through the nozzle (23).

10. The lubrication device according to claim 1, characterized in that it includes means for rotationally coupling the movable part (27) of the nozzle (23) to the fixed part (26).

11. A process for assembling a lubrication device (1) according to claim 1 characterised in that it includes the following steps:

moving the movable part (27) of the nozzle (23) to the retracted position, mounting the rotor (2) axially inside the stator (22), so that the movable part (27) of the nozzle (23) is axially arranged opposite to the lubrication chamber (6).

12. The process for assembling a lubrication device (1) according to claim 11 characterised in that it includes the following step:

moving the movable part (27) of the nozzle (23) to the extended position.

* * * * *